US007412189B2

(12) United States Patent
Jeong

(10) Patent No.: US 7,412,189 B2
(45) Date of Patent: Aug. 12, 2008

(54) WET-TYPE ELECTROPHOTOGRAPHIC IMAGE FORMING APPARATUS AND A SETTING METHOD THEREOF

(75) Inventor: Yoo-hung Jeong, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 404 days.

(21) Appl. No.: 11/171,400

(22) Filed: Jul. 1, 2005

(65) Prior Publication Data

US 2006/0002742 A1 Jan. 5, 2006

(30) Foreign Application Priority Data

Jul. 2, 2004 (KR) ..... 10-2004-0051585

(51) Int. Cl.
*G03G 15/10* (2006.01)

(52) U.S. Cl. ..... 399/120; 399/238; 222/DIG. 1

(58) Field of Classification Search ..... 399/120, 399/237, 238, 262; 347/85–87; 222/160, 222/162, 325, 372, 373, 380, 400.7, DIG. 1; 137/581; 141/275, 284
See application file for complete search history.

(56) References Cited

U.S. PATENT DOCUMENTS 4,574,852 A * 3/1986 Fleck et al. ..... 141/286
5,142,334 A * 8/1992 Iemura et al. ..... 399/237
5,156,308 A * 10/1992 Aoyama ..... 222/145.5
5,396,316 A * 3/1995 Smith ..... 399/120
5,519,474 A * 5/1996 Arcaro et al. ..... 399/238
5,621,445 A * 4/1997 Fong et al. ..... 347/87
5,631,681 A * 5/1997 Klaus et al. ..... 347/85
6,290,343 B1 * 9/2001 Lewis et al. ..... 347/85
7,212,766 B2 * 5/2007 Kang ..... 399/110

FOREIGN PATENT DOCUMENTS

JP P04-000540 1/1992
JP 05107933 A * 4/1993
JP 2000-103078 4/2000
JP 2001-171139 6/2001
JP 2002296915 A * 10/2002
JP 2002-326368 11/2002
KR 2003-015837 2/2003

* cited by examiner

*Primary Examiner*—Robert Beatty
(74) *Attorney, Agent, or Firm*—Roylance, Abrams, Berdo & Goodman, L.L.P.

(57) ABSTRACT

A wet-type electrophotographic image forming apparatus comprises a main body, a developing unit disposed inside the main body, a developer cartridge for providing developer to and collecting developer from the developing unit, and a fitting unit for connecting the developer cartridge with the developing unit. The fitting unit comprises a first fitting part disposed in the main body, a second fitting part disposed in the developer cartridge, and a third fitting part disposed in the developing unit. The fitting unit is connected to and disconnected from the second and third fitting parts by raising and lowering the parts. The method of setting up the system includes the step of raising a first female fitting part to connect first and second female fitting parts with a male fitting part.

20 Claims, 8 Drawing Sheets

WET-TYPE ELECTROPHOTOGRAPHIC IMAGE FORMING APPARATUS AND A SETTING METHOD THEREOF

CROSS-REFERENCE TO RELATED APPLICATIONS

This application claims the benefit under 35 U.S.C. § 119 (a) of Korean Patent Application Serial No. 2004-51585, filed on Jul. 2, 2004, in the Korean Intellectual Property Office, the entire disclosure of which is hereby incorporated by reference.

BACKGROUND OF THE INVENTION

1. Field of the Invention

The present invention relates to a wet-type electrophotographic image forming apparatus using a liquid developer. More particularly, the present invention relates to a wet-type electrophotographic image forming apparatus that includes a fitting unit and a developer cartridge for supplying developer to and collecting developer from a developing unit, and a method of setting up the same.

2. Description of the Related Art

Generally, electrophotographic image forming apparatuses can be classified as either dry-type image forming apparatuses that use a dry powder developer or wet-type image forming apparatuses that use a liquid developer. Dry-type and wet-type image forming apparatuses each have distinctive characteristics. Generally, wet-type image forming apparatuses have better print quality, with higher definition and resolution, than dry-type image forming apparatuses. As digital cameras have become more popular, the demand for color image forming apparatuses has greatly increased. They have especially increased demand for printers that produce high resolution, natural-color, prints.

To produce a desired level of print quality with a wet-type image forming apparatus, it is necessary to provide a developing unit with a larger amount of developer than the amount actually required for printing. For this reason, excess, unused developer is collected and returned to a developer cartridge. FIG. 1 schematically illustrates a conventional wet-type electrophotographic image forming apparatus that provides and collects developer.

As shown in FIG. 1, the conventional wet-type electrophotographic image forming apparatus includes a developer cartridge 10, a developing unit 40, and a fitting unit 30. The fitting unit 30 connects the developer cartridge 10 and the developing unit 40.

A first male fitting part 41 is disposed at the bottom of the developing unit 40, and a first female fitting part 12 is disposed at the top of the developer cartridge 10. The fitting unit 30 includes a second female fitting part 31 connected to the first male fitting part 41 of the developing unit 40, a second male fitting part 32 connected to the first female fitting part 12 of the developer cartridge 10, and a tube 33 for connecting the second female fitting part 31 with the second male fitting part 32, thereby creating a passage for developer. A supply pump 21 provides developer from the developer cartridge 10 to the developing unit 40 through a connection tube 22. The developer injected into the developing unit 40 is used in the image forming operation, and any remaining developer is returned to the developer cartridge 10 through the fitting unit 30.

To collect the wet-type developer, the printer must have a connection device for connecting the developing unit 40 to the developer cartridge 10. Because of the characteristics of wet-type developers, the connection device must seal tightly.

In a conventional wet-type electrophotographic image forming apparatus, the first male fitting part 41 and the first female fitting part 12 are generally applied to the developing unit 40 and the developer cartridge 10, respectively. However, when the developing unit 40 is configured to include the first male fitting part 41, the developing unit 40 becomes bulky. This reduces the ability to use the developing unit as a consumable item. Furthermore, it complicates the assembly of the connection between the developer cartridge 10 and the developing unit 40 through the use of the fitting unit 30. That is, the first male fitting part 41 of the developing unit 40 must be connected to the second female fitting part 31 of the fitting unit 30 to connect the developing unit 40 with the fitting unit 30, and the second male fitting part 32 of the fitting unit 30 must be connected to the first female fitting part 12 of the developer cartridge 10 to connect the developer cartridge 10 with the fitting unit 30.

To address the above-described problem, the fitting part has been removed from the developing unit 40. A wet-type electrophotographic image forming apparatus using a developing unit without a fitting part is depicted in FIG. 2. As illustrated, the developing unit 40 includes an outlet 42 to discharge developer and an outlet lid 43. A fitting unit 30' includes a collector 34, a tube 35, and a male fitting part 36. The male fitting part 36 is connected to or disconnected from a female fitting part 12 on the developer cartridge 10. Any developer remaining in the developing unit 40 discharges out the outlet lid 43 through the outlet 42 and passes through the collector 34, the tube 35, the male fitting part 36, and the female fitting part 12 to flow into the developer cartridge 10. With this configuration, when a user installs the developer cartridge 10, the user has to open the outlet lid 43 and connect the female fitting part 12 to the male fitting part 36 to thereby establish the connection between the developing unit 40 and the fitting unit 30' and between the fitting unit 30' and the developer cartridge 10.

With this configuration, although the fitting part of the developing unit 40 is eliminated, the outlet 42 and the outlet lid 43 are required instead. Thus, the developing unit 40 is still bulky. Also, it is still necessary to install the collector 34, thereby increasing the overall size of the wet-type electrophotographic image forming apparatus. Furthermore, this configuration reduces the security and preciseness of the connection between the developing unit 40 and the fitting unit 30'.

Accordingly, there is a need for an electrophotographic image forming apparatus with an improved fitting unit between a developer unit and a developer cartridge.

SUMMARY OF THE INVENTION

An aspect of the present invention is to solve at least the above problems and/or disadvantages and to provide at least the advantages described below. Accordingly, an aspect of the present invention is to provide a smaller wet-type electrophotographic image forming apparatus by decreasing the size of a developing unit and providing a more uniformly shaped developing unit.

It is another object of the present invention to provide a wet-type electrophotographic image forming apparatus with an improved structure that allows easy set up of the developing unit and a method for setting up the developing unit.

In accordance with an aspect of the present invention, a wet-type electrophotographic image forming apparatus has a main body and a developing unit disposed inside the main body. A developer cartridge provides developer to the developing unit and collects developer from the developing unit. A fitting unit connects the developer cartridge to the developing unit. The fitting unit includes a first fitting part disposed in the main body, a second fitting part disposed in the developer cartridge, and a third fitting part disposed in the developing unit. The fitting unit is connected and disconnected as the second and third fitting parts are raised and lowered.

Preferably, the first fitting part is a male fitting part fixed in the main body, the second fitting part is disposed inside the developer cartridge, and the third fitting part is disposed inside the developing unit. The second and third fitting parts are connected to the male fitting part.

Using the configuration described above, the developing unit and the developer cartridge are smaller because the first female fitting part and the second female fitting part are disposed inside the developer cartridge and the developing unit, respectively. The reduction in size of these components allows the wet-type electrophotographic image forming apparatus to be made smaller as well.

The fitting unit is mounted to and separated from the second female fitting part by raising and lowering the first female fitting part. To do this, the developer cartridge has a vertical guide opening formed on the outside of the developer cartridge. The first female fitting part has a lever that moves along the guide opening. Thus, the first female fitting is connected to and disconnected from the male fitting part by simply maneuvering the lever up and down. Raising the first female fitting part connects the first fitting part to the third fitting part.

Preferably, the first female fitting part comprises a body with a lever on its outside and an upper opening on its top side. A pin is disposed inside the body and opens and closes the upper opening. A corrugated tube forms a flow passage between the body and the pin. Preferably, the corrugated tube is formed by an elastic material that allows the corrugated tube to fold and unfold as the body is raised and lowered.

The male fitting part preferably comprises a first male fitting element connected to the first female fitting part, a second male fitting element connected to the second female fitting part, and a case fixed in the main body and encompassing the first male fitting element and the second male fitting element. The male fitting part further includes a connection body that connects with a bottom part of the second male fitting element and encompasses the first male fitting element. The second male fitting element moves up when the connection body is raised so that it connects with the second female fitting part.

In accordance with another aspect of the present invention, a method for setting up a wet-type electrophotographic image forming apparatus comprises the steps of maneuvering the lever formed on the first female fitting part, raising the first female fitting part, and connecting the male fitting part and the first and the second female fitting parts of the fitting unit with each other by raising the first female fitting part.

It is also preferred that at the step of raising the first female fitting part, the first female fitting part is raised by maneuvering the lever formed on the first female fitting part.

Preferably, the step of connecting the male fitting part and the first and the second female fitting parts with each other includes the steps of connecting the first female fitting part with the male fitting part by raising the first female fitting part, and connecting the male fitting part with the second female fitting part.

Preferably, at the step of connecting the first female fitting part with the male fitting part, the upward movement of the first female fitting part causes the first female fitting part to connect to the first male fitting element. Further, at the step of connecting the second female fitting part with the male fitting part, the upward movement of the first female fitting part causes the second male fitting element to connect to the second female fitting part.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
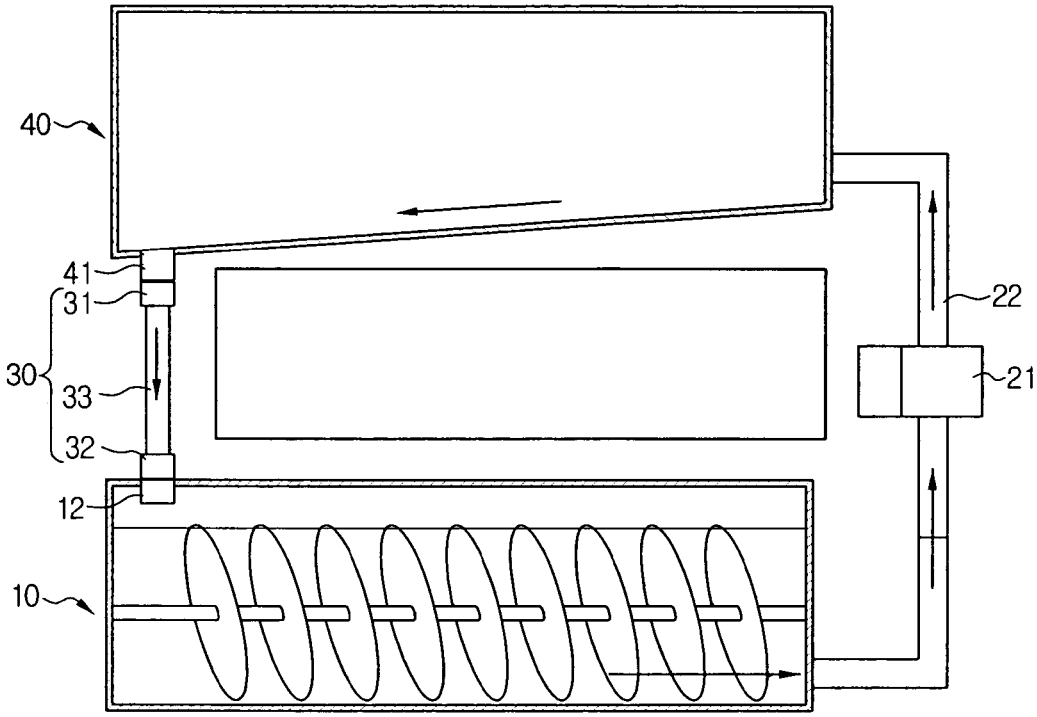
FIG. 1 (PRIOR ART)
FIG. 1 is a diagram of a conventional wet-type electrophotographic image forming apparatus.
Figure 2:
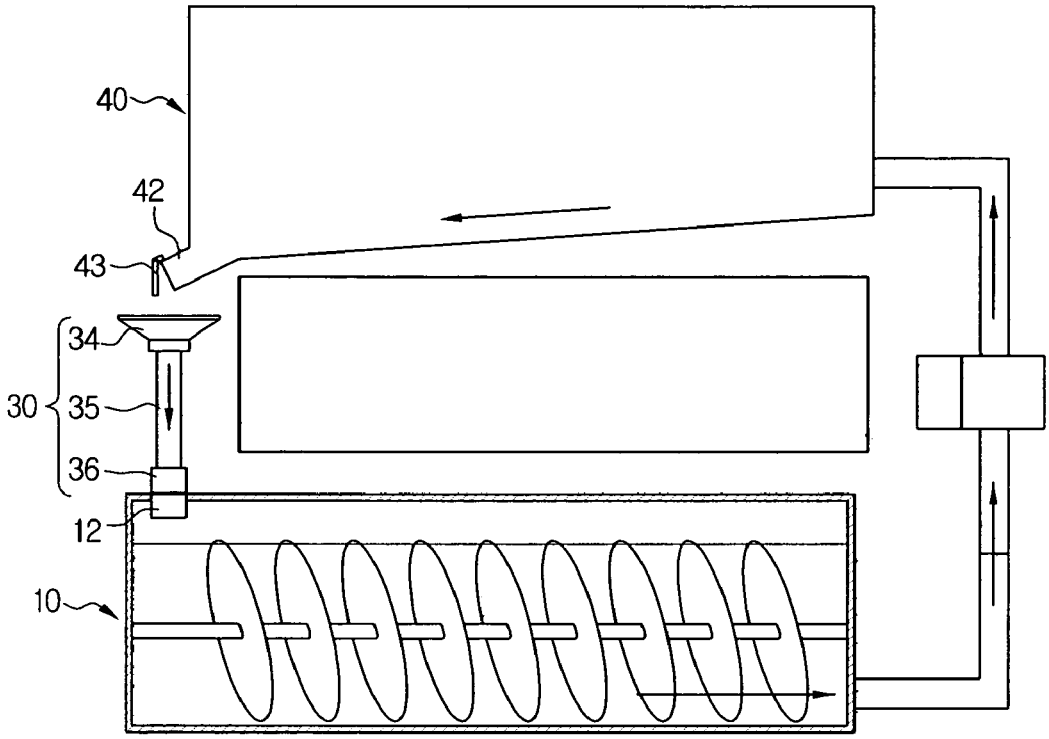
FIG. 2 (PRIOR ART)
FIG. 2 is a diagram of another conventional wet-type electrophotographic image forming apparatus.
Figure 3:
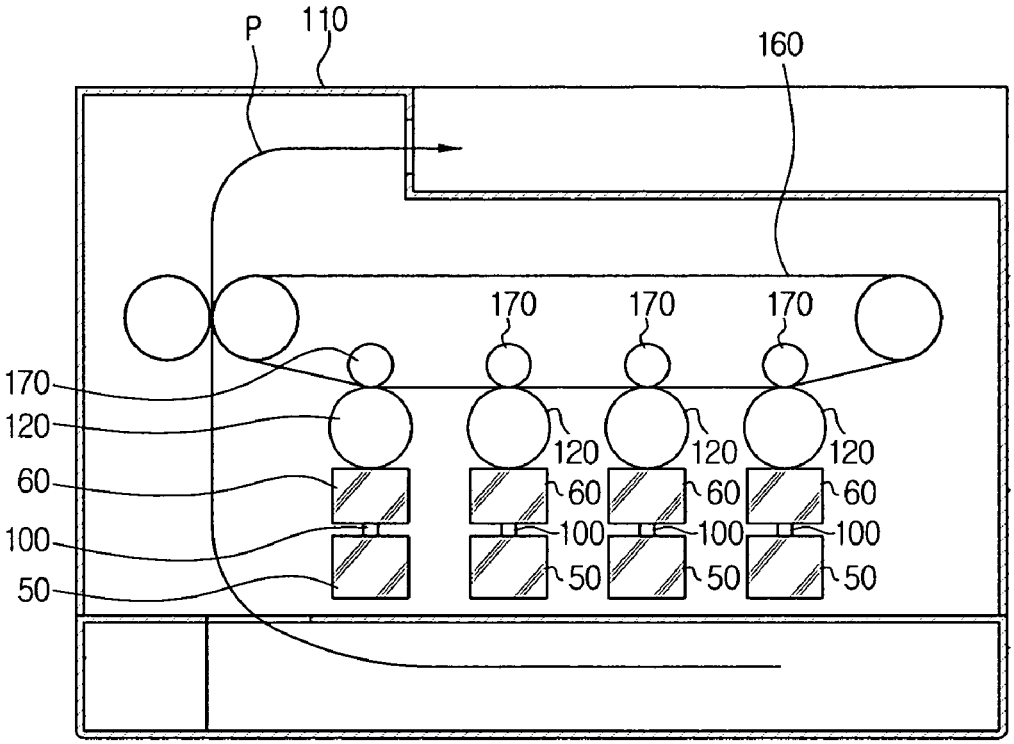
FIG. 3 is a schematic diagram of a wet-type electrophotographic image forming apparatus in accordance with an embodiment of the present invention.

With reference to FIG. 3, a wet-type electrophotographic image forming apparatus comprises a main body 110, a plurality of photosensitive drums 120 where electrostatic images are formed, a plurality of developing units 60 for generating visible images by providing a developer to each of the photosensitive drums 120, an intermediate transfer belt 160 where a final, superimposed image is generated, and a plurality of backup rollers 170 for transferring the visible images generated on the photosensitive drums 120 onto the intermediate transfer belt 160.

The wet-type electrophotographic image forming apparatus further includes a plurality of developer cartridges 50 for providing developer to and collecting developer from each of the developing units 60 and a plurality of fitting units 100 for making a connection between each pair of developing units 60 and the developer cartridges 50. Each of the developer cartridges 50 contains a different color developer and provides a different color developer to the individual developing units 60.

A pump (not shown) provides developer from each individual developer cartridge 50 to each individual developing unit 60. Excess developer remaining in the developing units 60 after printing is completed is collected and returned to the developer cartridges 50 through the fitting units 100.

Figure 4:
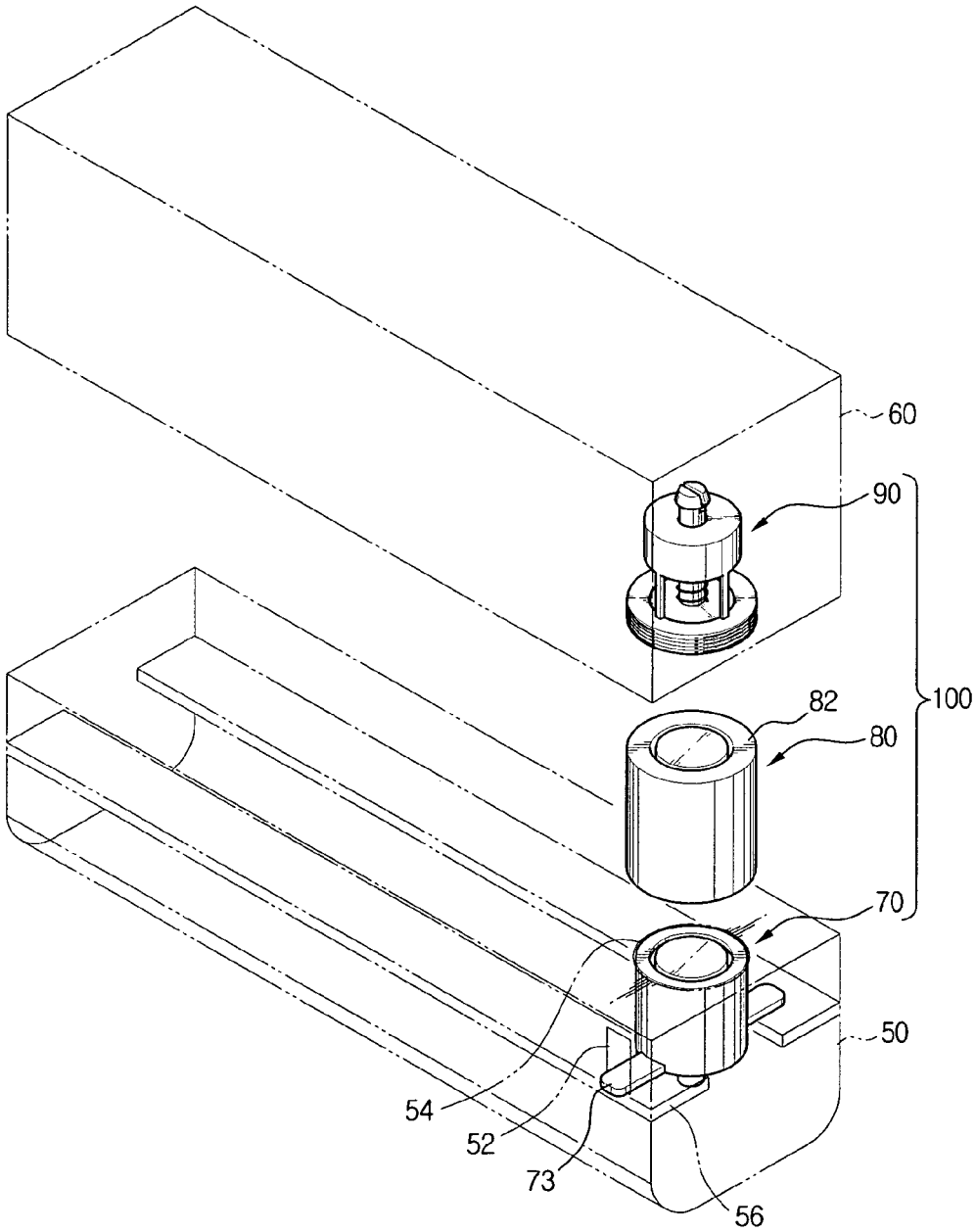
FIG. 4 is an enlarged perspective view of the main components of the wet-type electrophotographic image forming apparatus shown in FIG. 3.

FIG. 4 is an enlarged, perspective view of the developing unit 60, the fitting unit 100 and the developer cartridge 50 shown in FIG. 3. The fitting unit 100 includes a first fitting part 80 placed in the main body 110 (shown in FIG. 3), a second fitting part 70 placed in the developer cartridge 50, and a third fitting part 90 placed in the developing unit 60. The second fitting part 70 and the third fitting part 90 are placed inside the developer cartridge 50 and the developing unit 60, respectively, and are referred to as a first female fitting part 70 and a second female fitting part 90, respectively. Also, the first fitting part is referred to as a male fitting part 80.

The developer cartridge 50 contains developer. A vertical guide opening 52 is formed on one side of the developer cartridge 50 to allow a lever 73 of the first female fitting part 70 to move up and down. An opening 54 on the upper side of the developer cartridge 50 allows the first female fitting part 70 to move up and down. An isolation member 56 is disposed inside the developer cartridge 50 and helps prevent the developer contained within the developer cartridge 50 from flowing out of the guide opening 52.

Figure 6:
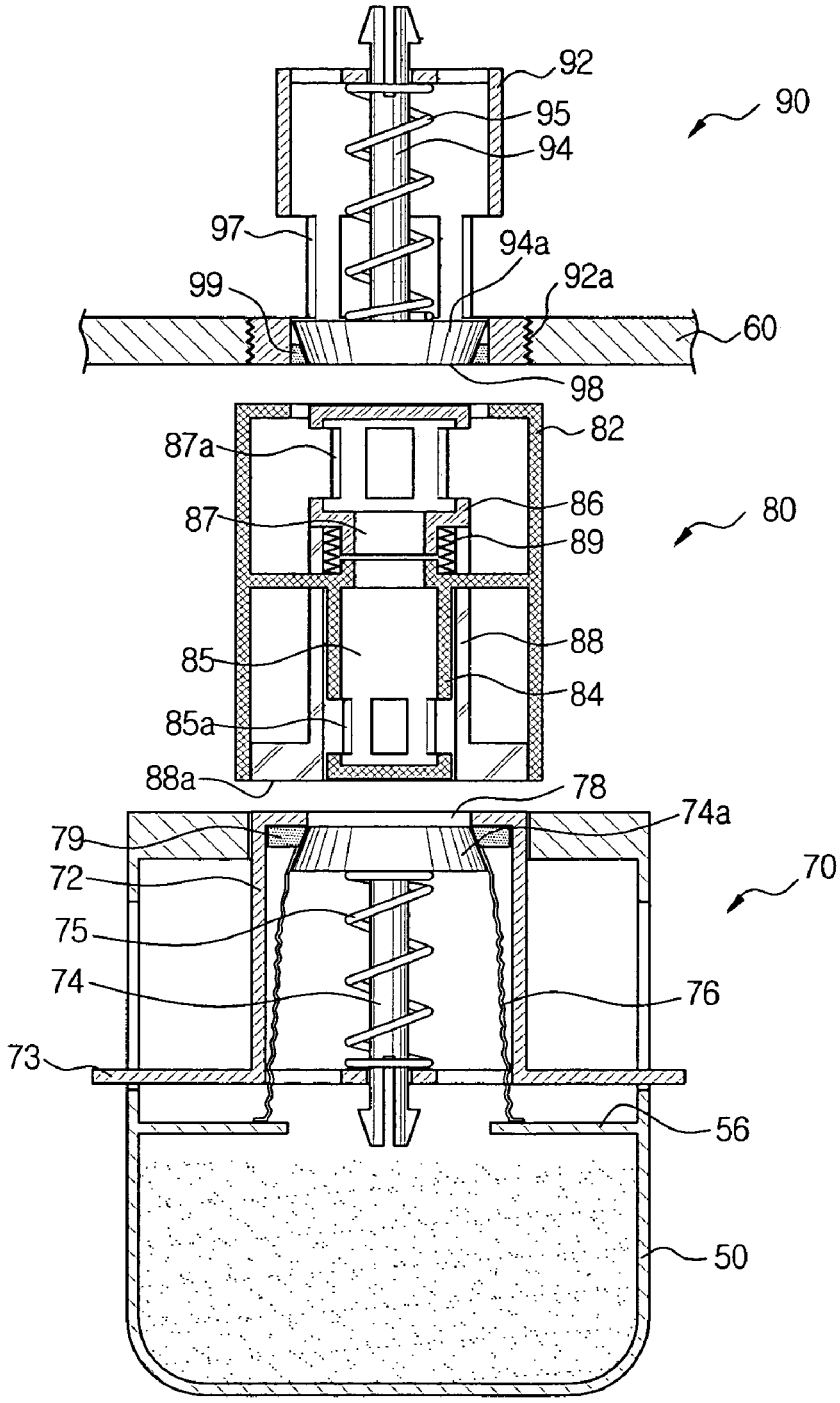
FIG. 6 is a cross-sectional view of the fitting unit shown in FIG. 4 in a disconnected state.

The fitting unit 100 comprises the male fitting part 80 placed in one side of the main body 110 (shown in FIG. 3), the first female fitting part 70 disposed inside the developer cartridge 50, and the second female fitting part 90 disposed inside the developing unit 60. In detail, the male fitting part 80, as shown in FIG. 6, comprises a first male fitting element 84, a second male fitting element 86, and a case 82. The first male fitting element 84 is connected to the first female fitting part 70, while the second male fitting element 86 is connected to the second female fitting part 90. The case 82 encompasses the first male fitting element 84 and the second male fitting element 86. The first male fitting element 84, the second male fitting element 86, and the case 82 will be described in detail further below.

Figure 5:
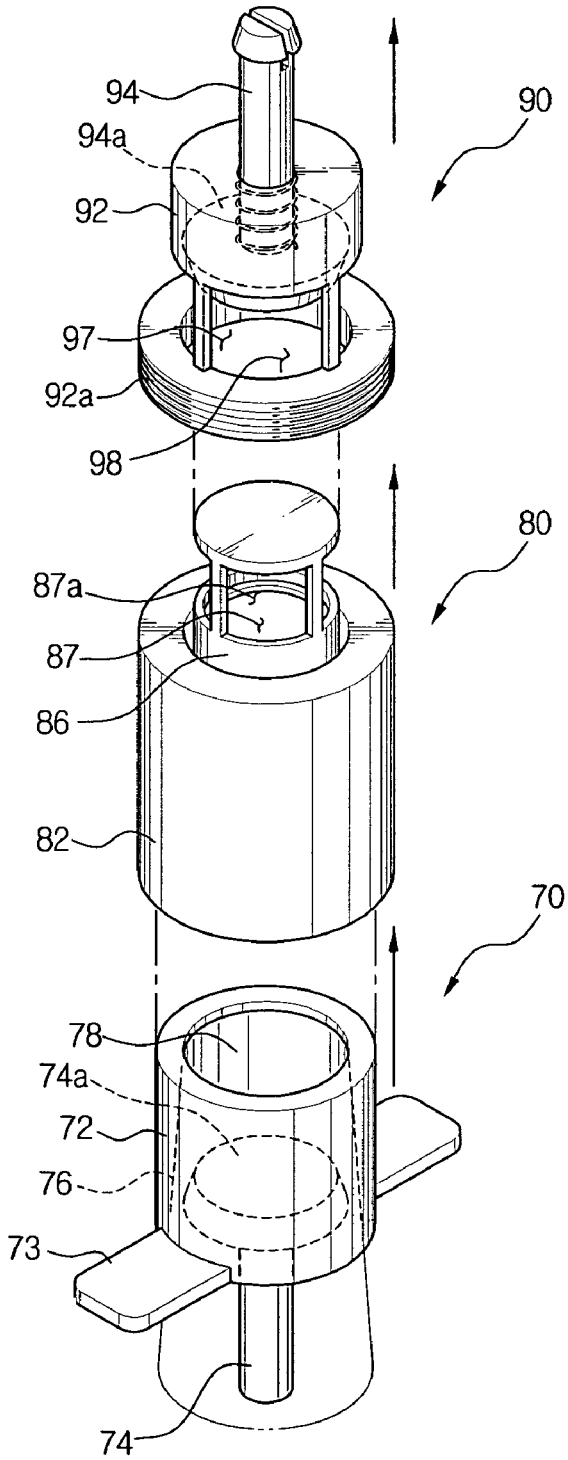
FIG. 5 is an exploded perspective view of the fitting unit shown in FIG. 4.
Figure 7:
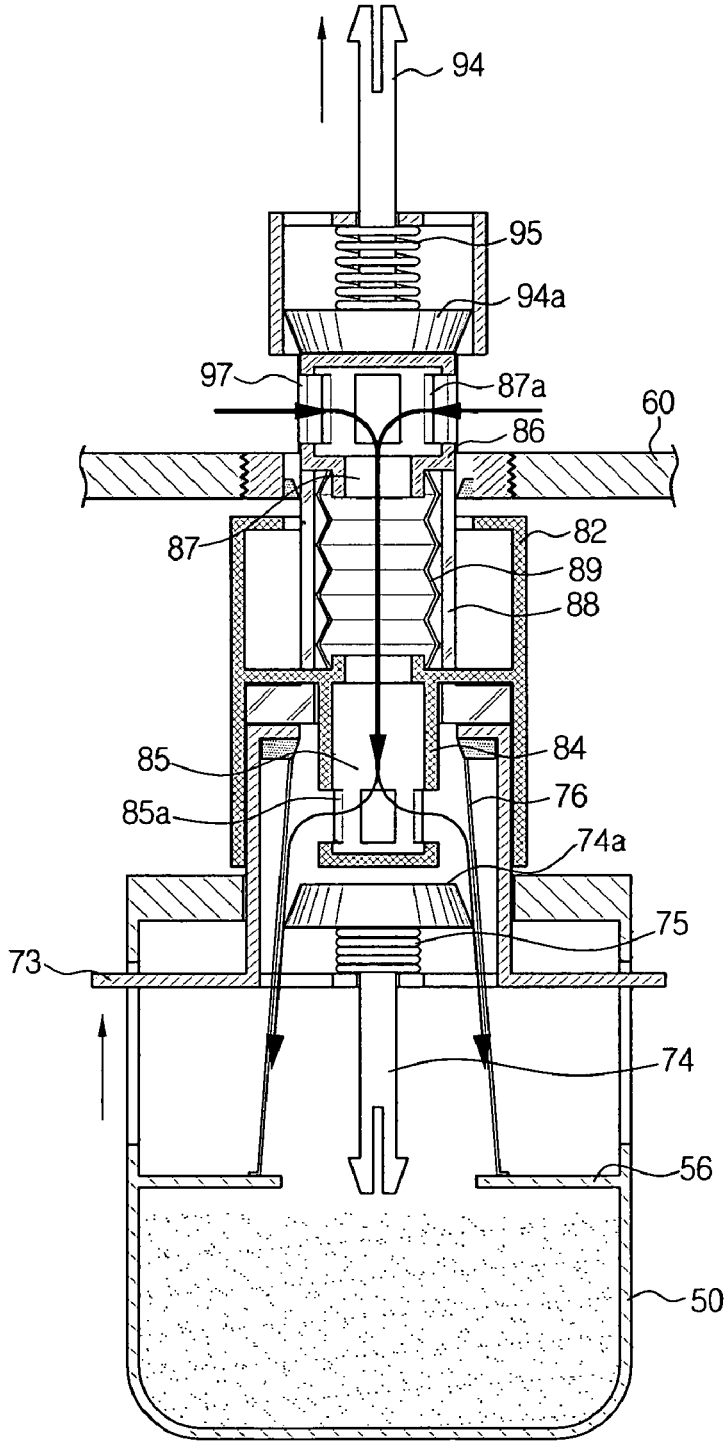
FIG. 7 is a cross-sectional view of the fitting unit shown in FIG. 4 in a connected state.
Figure 8:
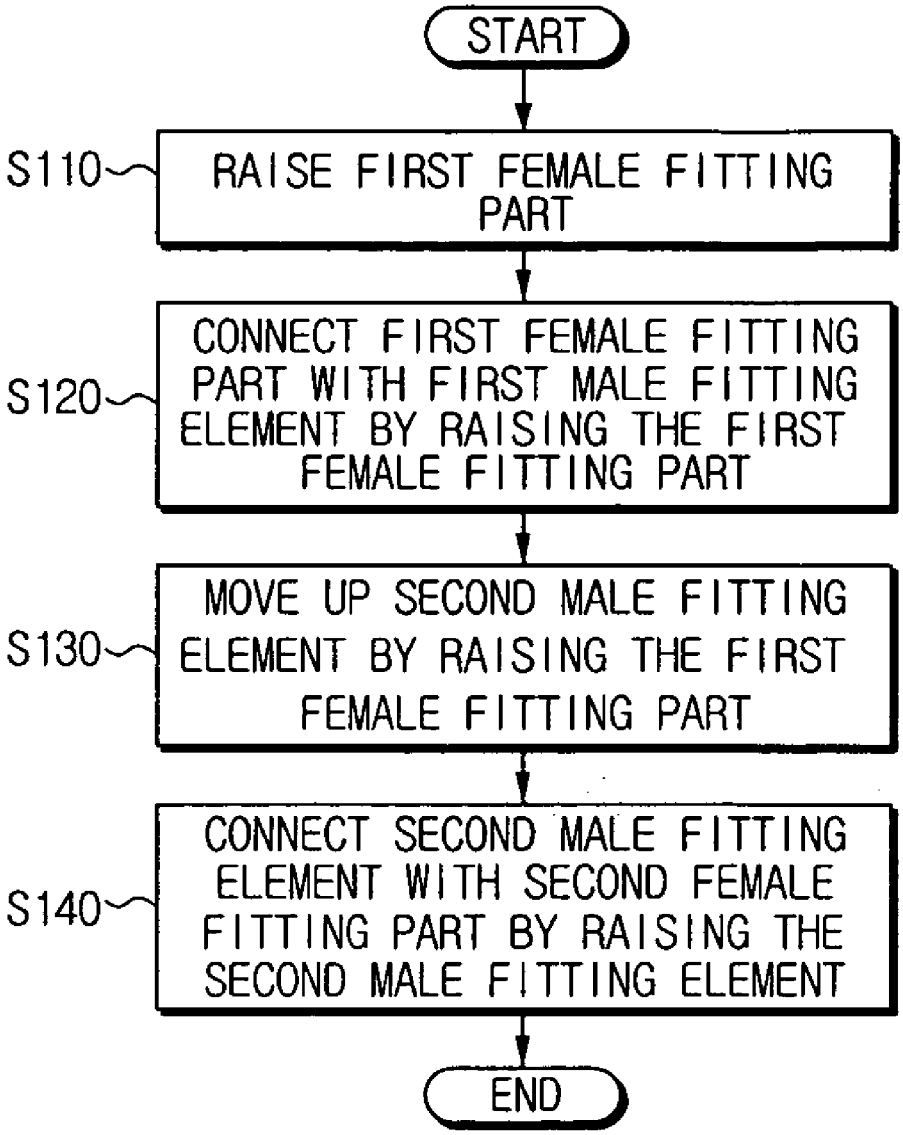
FIG. 8 is a flowchart describing a method of setting up a wet-type electrophotographic image forming apparatus in accordance with an embodiment of the present invention.

An embodiment of the fitting unit 100 in accordance with the present invention will be explained in more detail with reference to FIGS. 5 to 7. FIG. 5 is an exploded perspective view of the fitting unit 100 in a connected state. FIG. 6 is a cross-sectional view of the fitting unit 100 in a disconnected state. FIG. 7 is a cross-sectional view of the fitting unit 100 in a connected state.

The first female fitting part 70 is placed inside the developer cartridge 50 as described above and is disposed to move up and down through the opening 54 of the developer cartridge 50 to connect to the male fitting part 80. The first female fitting part 70 includes a first body 72, a first pin 74 placed inside of the first body 72 and a corrugated tube 76. Unlike the second female fitting part 90 that can be separated from and combined with the developing unit 60, the first female fitting part 70 is preferably disposed inside the developer cartridge 50 to form an integrated structure.

The first body 72 has a hollow, circular shape with a predetermined thickness. The outer diameter of the first body 72 corresponds to the size of the opening 54 of the developer cartridge 50. The lever 73 is disposed on the first body 72 so that it can move up and down in the guide opening 52 formed on the outer surface of the developer cartridge 50. That is, as shown in FIG. 4, the lever 73 protrudes out from the guide opening 52. Therefore, a user can move the lever 73 up and down, so that the first body 72 of the first female fitting part 70 raises and lowers. As illustrated in FIGS. 6 and 7, as the first body 72 raises to connect the first female fitting part 70 with the male fitting part 80, the first body 72 is inserted inside the case 82 of the male fitting part 80. As the lever 73 continues to rise, the bottom surface 88*a* of a connection body 88 of the male fitting part 80 is pushed up. As a result, the second male fitting element 86 (which is connected to the connection body 88) starts rising. A first sealing member 79 formed inside the upper portion of the first body 72 forms a tight seal during flow of the developer.

The first pin 74 is placed inside the first body 72 and includes a first spring 75 formed along an outer circumferential surface of the first pin 74. The first spring elastically biases the lever 73 and allows the first pin 74 to be supported inside of the first body 72.

The upper portion 4*a* of the first pin 74 is a circular plate and opens and closes an upper opening 78 of the first body 72. Hence, when the first female fitting part 70 and the male fitting part 80 are not connected to each other, the upper opening 78 of the first body 72 is closed by the upper portion 74*a* of the first pin 74, thereby preventing developer from flowing into the developer cartridge 50. When the lever 73 is raised to raise the first body 72 (as illustrated in FIG. 7), the first pin 74 does not rise. Rather, the first pin 74 is substantially fixed. Thus, the upper opening 78 is opened, and developer flowing out of the male fitting part 80 passes through the upper opening 78 of the first female fitting part 70 to flow into the developer cartridge 50.

The corrugated tube 76 passes completely through the first body 72. The lower portion of the corrugated tube 76 extends to the isolation member 56, while the upper portion of the tube is fixed to the upper end of the first body 72. This arrangement of the corrugated tube 76 enables the corrugated tube 76 to serve as a flow passage for developer in the developer cartridge 50. As shown in FIG. 6, when the developer cartridge 50 is separated from the male fitting part 80, that is, when the first female fitting part 70 is placed inside the developer cartridge 50, the corrugated tube 76 is folded. In contrast, as illustrated in FIG. 7, when the developer cartridge 50 is connected to the male fitting part 80, that is, when the first body 72 of the first female fitting part 70 is raised to connect to the male fitting part 80, the corrugated tube 76 is unfolded. As the corrugated tube 76 is unfolded, the developer flowing out of the male fitting part 80 starts flowing through the corrugated tube 76, thereby flowing into the developer cartridge 50.

The case 82 of the first male fitting element 84 is fixed at one side of the main body 110 (shown in FIG. 3) by a bracket (not shown). The case 82 encompasses the first male fitting element 84 and the second male fitting element 86.

The first male fitting element 84 extends downwardly to form a first inner channel 85 for developer. A developer outlet 85*a* is formed at the bottom lateral sides of the first male fitting element 84 to allow developer to flow out of the first inner channel 85. The upper end of the first male fitting element 84 is supported by the case 82, while the bottom end is closed. The connection body 88 encases the outer structure of the first male fitting element 84. The upper end of the second male fitting element 86 is closed, and a developer inlet 87*a* is formed at its upper lateral sides to allow developer to flow into the male fitting element 86 from the developing unit 60. A second inner channel 87 extends from the developer inlet 87*a* to the bottom end of the second male fitting element 86. As described above, the second male fitting element 86 raises as the connection body 88 is pushed upward when the first female fitting part 70 is raised. Thus, the second male fitting element 86 is inserted inside the second female fitting part 90. As a result, the second male fitting element 86 connects to the second female fitting part 90.

A connection tube 89 for connecting the first inner channel 85 of the first male fitting element 84 with the second inner channel 87 of the second female fitting element 86 is disposed between the first male fitting element 84 and the second male fitting element 86. The connection tube 89 is preferably made of an elastic material.

As shown in FIG. 4, the second female fitting part 90 is formed inside the developing unit 60 and includes a second body 92 and a second pin 94. As the second male fitting element 86 raises, the second pin 94 also ascends due to contact with the second male fitting element 86.

The second body 92 has a circular, hollow shape. A pair of channels 97 for allowing inflow of developer are formed at the bottom lateral sides of the second body 92. Screw threads 92*a* at the bottom of the second body 92 enable the second body to be connected and disconnected to the developing unit 60. The second pin 94 is disposed inside the second body 92, and a second spring 95 that elastically biases the second pin 94 is formed around an outer circumferential surface of the second pin 94. The bottom portion 94*a* of the second pin 94 is a circular plate for opening and closing a bottom opening 98 of the second body 92. Thus, when the second female fitting part 90 is not connected to the male fitting part 80, the bottom opening 98 of the second body 92 is closed by the bottom portion 94*a* and thus, developer is not allowed to flow out of the developing unit 60. However, as shown in FIGS. 5 and 7, when the second male fitting element 86 ascends, the second male fitting element 86 pushes up the second pin 94 due to the contact with the bottom portion 94*a* of the second pin 94; A second sealing member 99 formed inside the upper portion of the first body 72 forms a tight seal during flow of the developer. As a result, the second male fitting element 86 is inserted into the bottom opening 98, and the developer contained within the developing unit 60 flows into the inlets 87*a* of the second male fitting element 86 through the channel 97 of the second body 92. Placing the second female fitting part 90 into the developing unit 60 reduces the size of the developing unit 60.

The process of collecting developer in the wet-type electrophotographic image forming apparatus will be described with reference to FIG. 7. Any developer remaining in the developing unit 60 after printing is completed flows into the inlets 87*a* of the second male fitting element 86 through the channel 97 of the second female fitting part 90. The developer runs down the second inner channel 87 of the second male fitting part 86, passes through the connection tube 89, and flows into the first inner channel 85 of the first male fitting element 84. The developer then flows out of the first male fitting element 84 through the outlets 85*a* of the first male fitting element 84, and flows down through the corrugated tube 76 of the first female fitting part 70. As a result, the developer is collected at the developer cartridge 50.

A method for setting up a wet-type electrophotographic image forming apparatus in accordance with an embodiment of the present invention will be explained with reference to FIGS. 3 to 8. First, the developing unit 60 and the developer cartridge 50 are installed inside the main body 110. The developing unit 60 and the developer cartridge 50 are consumable parts. Although specific apparatuses have different lifespans, in general, the developing unit 60 has a lifespan three times longer than the developer cartridge 50. Thus, the developer cartridge 50 must be exchanged more frequently than the developing unit 60.

Once the developing unit 60 and the developer cartridge 50 are installed, the lever 73 of the first female fitting part 70 is moved up. The movement of the lever raises the first body 72 of the first female fitting part 70 while the first pin 74 remains at the same position (step S110). As the first body 72 ascends, the first body 72 contacts the bottom surface of the connection body 88 of the male fitting part 80. At step S120, the first body 72 of the first female fitting part 70 ascends to a predetermined height so that the first body 72 is inserted into the male fitting part 80 and, thus, connected to the first male fitting element 84. Therefore, the first male fitting element 84 is encompassed by the second body 72 of the first female fitting part 70 rather than the connection body 88 of the second male fitting element 86. Further, as a result of the movement of the connection body 88, at step S130, the second male fitting element 86 is also raised.

At step S140, as the second male fitting element 86 is raised, the second male fitting element 86 makes contact with the bottom portion 94*a* of the second pin 94 of the second female fitting part 90. Thus, because of the continuous raising of the second male fitting element 86, the second pin 94 also raises. At this time, the second male fitting element 86 is placed inside the second body 92 to connect to the second female fitting part 90.

As the first body 72 of the first female fitting part 70 moves up, the first body 72 is inserted into the male fitting part 80, while the second male fitting element 86 is also inserted into the second female fitting part 90. As a result, connections are made between the developer cartridge 50 and the male fitting part 80 and between the male fitting part 80 and the developing unit 60, thereby resulting in circulation of the developer. Accordingly, simple maneuvering of the lever 73 of the first female fitting part 70 forms a connection between the developer cartridge 50 and the male fitting part 80 and between the male fitting part 80 and the developing unit 60. To separate the developer cartridge 50 or the developing unit 60 from the main body 110 of the wet-type electrophotographic image forming apparatus for replacement, the lever 73 descends, thereby breaking the connections between the developer cartridge 50 and the fitting unit 100 and between the fitting unit 100 and the developing unit 60.

Although the exemplary embodiment of the present invention described herein connects and disconnects the fitting unit 100 by raising and lowering the first female fitting part 70, it is possible to construct the fitting unit 100 so that is connected and disconnected by the raising and lowering the second female fitting part 90. For instance, similar to the above-described embodiment, the second female fitting part 90 can be provided with a lever member that causes the second female fitting part 90 to move down when the lever member is lowered. The lowering of the second female fitting part 90 connects it to the male fitting part 80. As the second female fitting part 90 continues to descend, the male fitting part 80 also descends, thereby connecting the male fitting part 80 to the first female fitting part 70.

In accordance with an embodiment of the present invention, the first female fitting part and the second female fitting part are disposed inside the developer cartridge and the developing unit, respectively. Therefore, the size of the developing unit is reduced, making the overall size of the wet-type electrophotographic image forming apparatus smaller. Moreover, the fitting unit, the developing unit, and the developer cartridge can be connected to each other through a simple operation.

While the invention has been shown and described with reference to certain embodiments thereof, it will be understood by those skilled in the art that various changes in form and details may be made therein without departing from the spirit and scope of the invention as defined by the appended claims.

What is claimed is:

1. A wet-type electrophotographic image forming apparatus, comprising:

a main body;

a developing unit disposed inside the main body;

a developer cartridge for providing developer to and collecting developer from the developing unit; and a fitting unit for connecting the developer cartridge with the developing unit, the fitting unit including, a first fitting part disposed in the main body, a second fitting part disposed in the developer cartridge, and a third fitting part disposed in the developing unit, wherein the second fitting part and the third fitting part are connected and disconnected with the first fitting part by raising and lowering either the second fitting part or the third fitting part.

2. A wet-type electrophotographic image forming apparatus, comprising:

a main body;

a developing unit disposed inside the main body;

a developer cartridge for providing developer to and collecting developer from the developing unit; and a fitting unit for connecting the developer cartridge with the developing unit, the fitting unit including, a first fitting part disposed in the main body, a second fitting part disposed in the developer cartridge, and a third fitting part disposed in the developing unit;

wherein the fitting unit is connected and disconnected by raising and lowering either the second fitting part or the third fitting part; and the first fitting part is a male fitting part fixed in the main body, the second fitting part is a first female fitting part disposed inside the developer cartridge, the third fitting part is a second female fitting part disposed inside the developing unit, and the first and second female fitting parts are detachably connected to the male fitting part.

3. The wet-type electrophotographic image forming apparatus of claim 2, wherein the fitting unit is connected and disconnected by raising and lowering the first female fitting part.

4. The wet-type electrophotographic image forming apparatus of claim 3, wherein the developer cartridge has a substantially vertical guide opening formed on the outside of the developer cartridge.

5. The wet-type electrophotographic image forming apparatus of claim 4, wherein the first female fitting part includes a lever moving along the substantially vertical guide opening, and the lever is raised and lowered to connect and disconnect the first female fitting part from the male fitting part.

6. The wet-type electrophotographic image forming apparatus of claim 5, wherein the first female fitting part comprises:

a body with the lever on the outside and an upper opening;

a pin disposed inside the body for opening and closing the upper opening; and a flexible tube disposed between the body and the pin to define a flow passage.

7. The wet-type electrophotographic image forming apparatus of claim 6, wherein the flexible tube is a corrugated tube formed of an elastic material that allows the tube to be folded and unfolded as the body is raised and lowered.

8. The wet-type electrophotographic image forming apparatus of claim 3, wherein the male fitting part comprising:

a first male fitting element to connect to the first female fitting part;

a second male fitting element to connect to the second female fitting part; and a case fixed in the main body and encompassing the first male fitting element and the second male fitting element.

9. The wet-type electrophotographic image forming apparatus of claim 8, wherein the second male fitting element is raised by the first female fitting part to be connected to the second female fitting part.

10. The wet-type electrophotographic image forming apparatus of claim 8, wherein the male fitting part further includes a connection body disposed to be connected to a bottom part of the second male fitting element and to encompass the first male fitting element, and the second male fitting element is raised by the connection body to be connected to the second female fitting part.

11. The wet-type electrophotographic image forming apparatus of claim 10, wherein the male fitting part further includes a connection tube connecting the first male fitting element with the second male fitting element.

12. The wet-type electrophotographic image forming apparatus of claim 2, wherein the fitting unit is connected and disconnected by raising and lowering of the second female fitting part.

13. A method for setting up a wet-type electrophotographic image forming apparatus including a developing unit, a developer cartridge, and a fitting unit for connecting the developing unit with the developer cartridge, the fitting unit including a male fitting part disposed in a main body of the image forming apparatus and first and second female fitting parts being disposed inside the developer cartridge and the developing unit, respectively, and connected to the male fitting part, the method comprising the steps of:

(a) maneuvering a lever formed on the first female fitting part;

(b) raising the first female fitting part; and (c) connecting the male fitting part and the first and the second female fitting parts of the fitting unit with each other by the raising of the first female fitting part.

14. The method of claim 13, wherein the male fitting part comprises:

a first male fitting element connected to the first female fitting part; and a second male fitting element connected to the second female fitting part.

15. The method of claim 14, wherein the step of (c) includes the steps of:

(c-1) connecting the first female fitting part with the first male fitting element by the raising of the first female fitting part;

(c-2) raising the second male fitting element by the raising of the first female fitting part;

and (c-3) connecting the second male fitting element with the second female fitting part by the raising of the second male fitting element.

16. A fitting unit for connecting a developer cartridge to a developing unit in a wet-type electrophotographic image forming apparatus, comprising:

a first fitting part disposed in a main body of the image forming apparatus;

a second fitting part disposed in the developer cartridge; and a third fitting part disposed in the developing unit;

wherein the second fitting part and the third fitting part are connected and disconnected with the first fitting part by raising and lowering either the second fitting part or the third fitting part.

17. A fitting unit for connecting a developer cartridge to a developing unit in a wet-type electrophotographic image forming apparatus, comprising:

a first fitting part disposed in a main body of the image forming apparatus, a second fitting part disposed in the developer cartridge, and a third fitting part disposed in the developing unit;

wherein the fitting unit is connected and disconnected by raising and lowering either the second fitting part or the third fitting part;

the first fitting part is a male fitting part fixed in the main body;

the second fitting part is a first female fitting part disposed inside the developer cartridge; and the third fitting part is a second female fitting part disposed inside the developing unit.

18. The fitting unit of claim 17, wherein the fitting unit is connected and disconnected by raising and lowering the first female fitting part.

19. The fitting unit of claim 18, wherein the developer cartridge has a substantially vertical guide opening formed on the outside of the developer cartridge.

20. The fitting unit of claim 19, wherein the first female fitting part includes a lever protruding through the substantially vertical guide opening, and the lever is raised and lowered to connect and disconnect the first female fitting part from the male fitting part.

* * * * *